US006267635B1

(12) United States Patent
Blair

(10) Patent No.: US 6,267,635 B1
(45) Date of Patent: Jul. 31, 2001

(54) FLOTATION DEVICE

(76) Inventor: J. William Blair, P.O. Box 530906, Birmingham, AL (US) 35253-0906

( * ) Notice: Subject to any disclaimer, the term of this patent is extended or adjusted under 35 U.S.C. 154(b) by 0 days.

(21) Appl. No.: 09/495,940

(22) Filed: Feb. 2, 2000

(51) Int. Cl.[7] ..... B63C 9/08
(52) U.S. Cl. ..... 441/130; 441/129
(58) Field of Search ..... 441/35, 65, 125, 441/126, 127, 129, 130, 131, 132, 133, 136

(56) References Cited

U.S. PATENT DOCUMENTS

| | | | | |
|---|---|---|---|---|
| 2,623,574 | * | 12/1952 | Damsch | 441/129 |
| 2,803,839 | * | 8/1957 | Mosley | 441/131 |
| 4,687,452 | * | 8/1987 | Hull | 441/131 |
| 5,290,196 | * | 3/1994 | Steel | 441/130 |
| 5,520,561 | * | 5/1996 | Langenohl | 441/129 |
| 5,885,123 | * | 3/1999 | Clifford | 441/136 |

FOREIGN PATENT DOCUMENTS

| | | | | |
|---|---|---|---|---|
| 2462332 | * | 3/1981 | (FR) | 441/130 |

* cited by examiner

*Primary Examiner*—Stephen Avila
(74) *Attorney, Agent, or Firm*—Dykema Gossett PLLC

(57) ABSTRACT

The back rest and arm rests of the chair each include a separate elongated buoyant flotation member having a hole extending longitudinally therethrough. A flexible connector such as a rope extends through the holes to interconnect the back rest and arm rests with one another. The opposite ends of the rope extend outwardly of the forward end of the arm rests, and manually operable adjuster devices are attached to the ends for varying the length of rope between the adjuster devices to vary the distance of the back rest relative to the arm rests. A seat is formed of flexible material and is suspended between the arm rests by sleeves formed at opposite sides of the seat which receive the flotation members of the arm rests. The sleeves surrounding each of the flotation members have end portions which enclose end portions of the associated flotation members to prevent the flotation members from escaping from the sleeves.

8 Claims, 4 Drawing Sheets

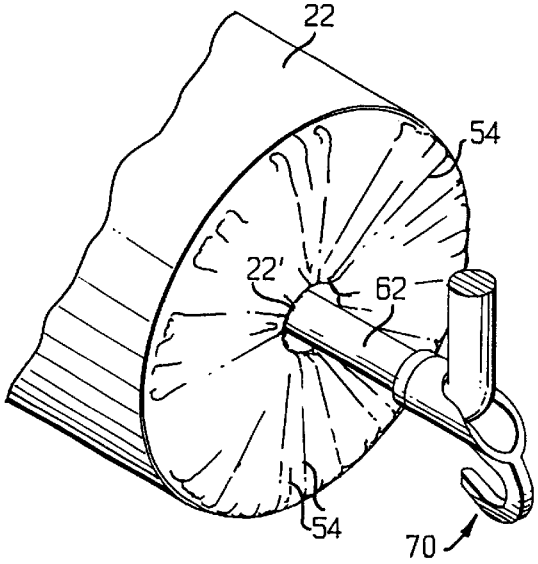
FIG.2A
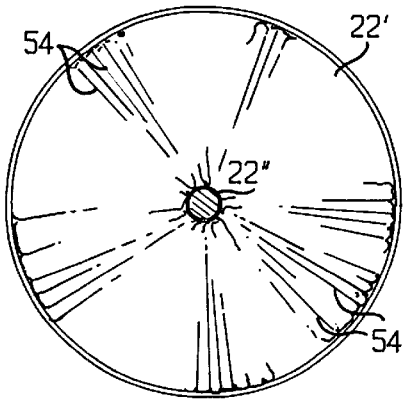
FIG.2B
FIG.3
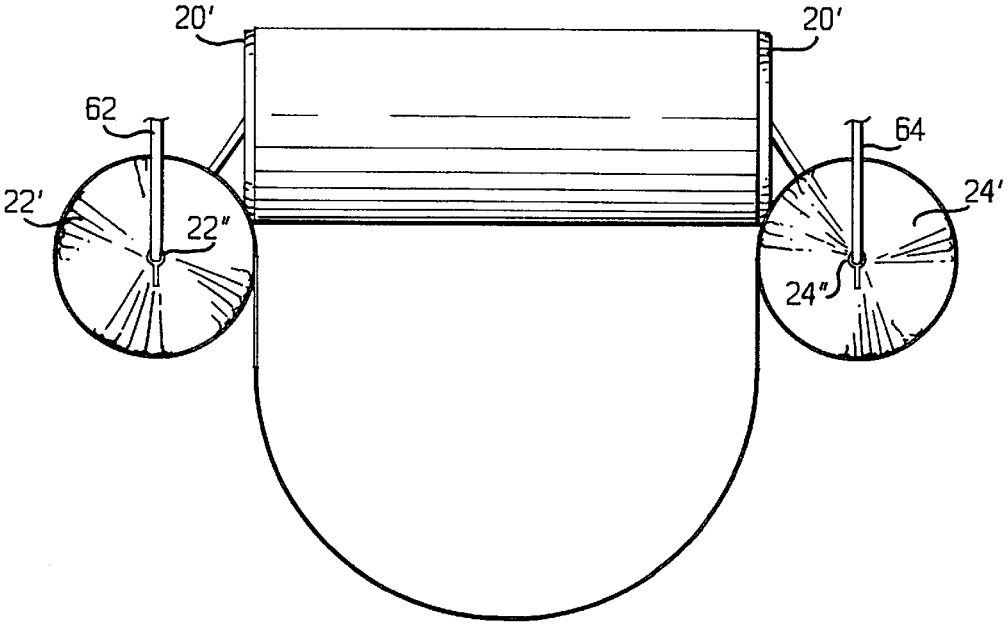

FLOTATION DEVICE

BACKGROUND OF THE INVENTION

The present invention relates to a flotation device, and more particularly to a floating chair which allows a user to sit in an upright position while a major portion of the user's body is disposed below the surface to the water.

The invention provides an improvement over the floating chair disclosed in U. S. Pat. No. 5,885,123, the disclosure of which is incorporated herein by reference. The background of the invention as set forth in this U. S. patent provides a good description of the prior art leading up to the development of the chair disclosed in the patent.

However, the patented chair structure is unsatisfactory since it suffers from a number of disadvantages. A significant problem with the patented chair structure is that it supports a user in a semi-reclining position. This position puts strain on the abdominal and frontal neck muscles of a user as he strives to keep his head up. Furthermore, the user must constantly kick his feet or tread water with his hand in order to move the chair toward a position wherein the user is more upright in the water.

The patented chair does not provide any means for adjusting the chair for users of different size, and as a result, users of different weight will not be uniformly supported by the chair. The patented chair also requires an elongated flotation member over five feet long which is difficult to store and awkward to handle. Also, the patented chair does not provide unrestricted use of a user's arms since the flotation member is disposed in the armpits of the user.

An additional problem with the patented chair is that the flotation member can slide out or move with respect to the sleeve within which it is disposed, thereby causing the chair to be unbalanced and unstable which requires the user to realign the flotation member in proper position.

SUMMARY OF THE INVENTION

The present invention incorporates a construction including a back rest portion, a pair of arm rest portions and a seat portion. Each of the arm rest portions comprises an elongated flotation member having a hole formed longitudinally therethrough. The seat portion is formed of flexible material and is connected to a pair of sleeves at opposite sides thereof. The arm rest portion flotation members are disposed within said pair of sleeves. Each sleeve has end portions which at least partially enclose end portions of the associated flotation member to prevent the flotation member from escaping from its sleeve.

The back rest portion comprises an elongated flotation member having a hole formed longitudinally therethrough. This flotation member may also be disposed within a sleeve having opposite end portions which at least partially enclose end portions of the associated flotation member to prevent the flotation member from escaping from its sleeve.

The back rest portion is interconnected with the arm rest portions by a flexible connector in the form of a rope which extends through the longitudinal holes formed in each of the flotation members. The rope has opposite ends which extend from the front of the arm rest portions. Manually operable adjusters are attached to the ends of the rope for adjusting the length of the rope which passes through the flotation members to vary the distance of the back rest portion relative to the arm rest portions.

With this construction, the chair supports a user in an upright totally relaxed position, and buoyancy is provided where the greatest mass of the human body is located, namely the torso and the upper thighs. The invention chair may be readily adjusted for different size users and is formed of relatively small components which can be easily stored and manipulated. When the invention is adjusted so that the back portion is spaced a maximum distance from the side portions, a user has a full range of arm motion for exercising in a backstroke position. Furthermore, the flotation members are prevented from sliding out of the associated sleeves.

BRIEF DESCRIPTION OF THE DRAWINGS

FIG. 2A is an enlarged perspective view of one end of a sleeve;

FIG. 2B is an end view of the sleeve shown in FIG. 2A;

FIG. 3 is a front view of the chair shown in FIG. 1;

DESCRIPTION OF THE PREFERRED EMBODIMENT

Figure 1:
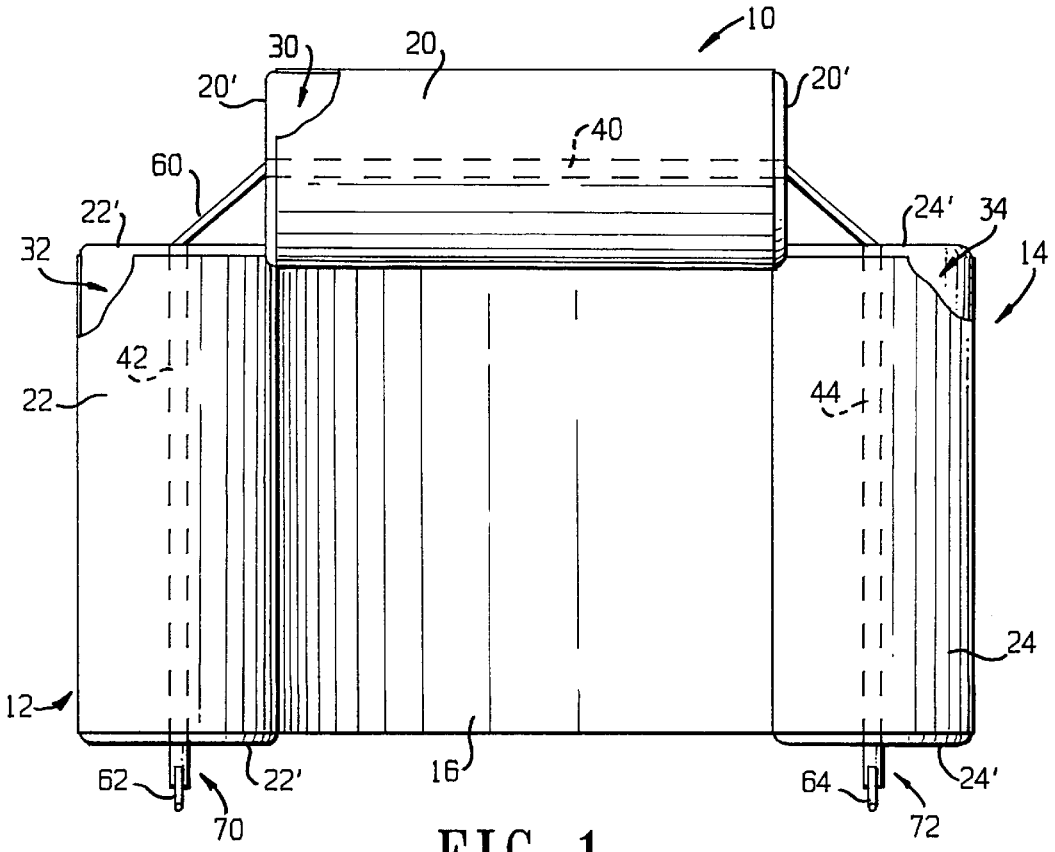
FIG. 1 is a top view, partly broken away, of a floating chair according to the invention.
Figure 2:
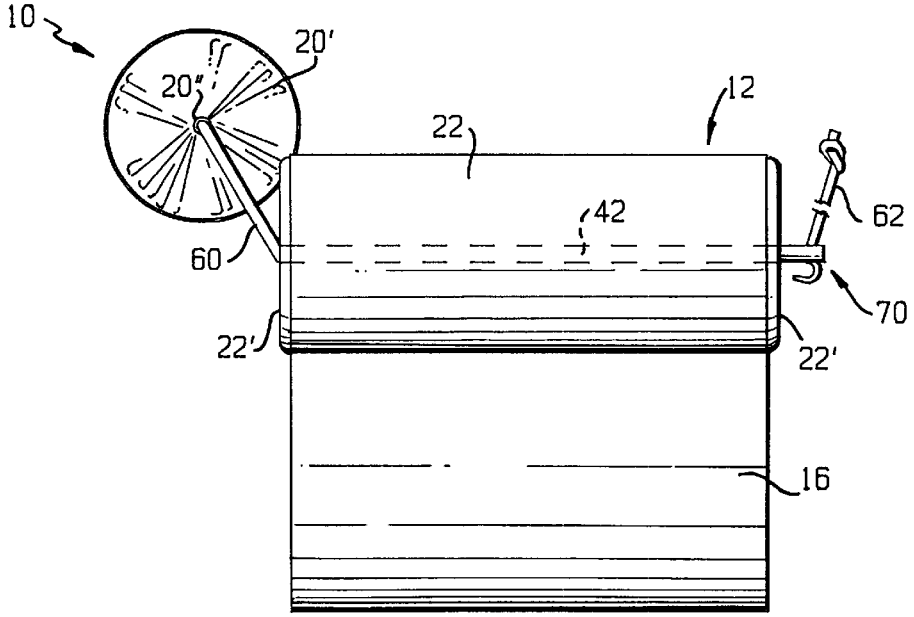
FIG. 2 is a side view of the chair shown in FIG. 1.

Referring to the drawings wherein like reference characters designate corresponding parts throughout the several views, there is shown in FIGS. 1–3 the chair of the invention including a back rest portion 10, a pair of arm rest portions 12 and 14, and a seat portion 16. Portions 10, 12, and 14 include generally cylindrical sleeves 20, 22, and 24 respectively which are formed of a suitable flexible fabric such as canvas or the like. Separate buoyant flotation members 30, 32, and 34 are disposed within sleeves 20, 22 and 24 respectively. Members 30, 32 and 34 are cylindrical elongated bodies of buoyant material such as STROFOAM or ETHAFOAM or other closed cell foam and the like. The flotation members may, for example, comprise 2 lb. density STYROFOAM cylinders which may be six inches in diameter or commercial grade ETHAFOAM six inch cylinders. While the sleeves and cylinders have been described as generally cylindrical in configuration, it is apparent that they may have different cross-sectional configurations other than circular if so desired.

Each of the flotation members has a central hole formed longitudinally therethrough for receiving a flexible connector described hereinafter. In order to prevent unnecessary wear on the material of flotation members, each of the holes is defined by a rigid tubular member which may be, for example, ½" cpvc pipe having an inside diameter of ⅜". The pipes 40. 42, and 44 are held in place with a tight fit within holes formed through flotation members 30, 32 and 34 respectively, the pipes extending between opposite ends of the associated flotation members.

The seat portion 16 is formed of the same material as sleeves 22 and 24, and the opposite sides 50 and 52 of the seat portion are secured as by stitching or the like to sleeves 22 and 24 respectively, as seen in FIG. 3. The opposite end portions of each of the sleeves extends inwardly to at least partially enclose the end portions of the associated flotation member to prevent the flotation member from escaping from the associated sleeve. As seen in FIGS. 2A and 2B, one end portion 22' of sleeve 22 is shown. End portion 22' is gathered to form a plurality of folds 54 which are stitched together at the inner ends of the folds to define a central opening 22" for receiving a connector hereinafter described. The opposite ends of all of the sleeves have a construction similar to that shown in FIGS. 2A and 2B. The end 24' of sleeve 24 as seen in FIG. 3 has a central opening 24" formed therein: and the end 20' of sleeve 20 as seen in FIG. 2 has a central opening 20" formed therein.

A flexible connector 60 is provided in the form of woven nylon marine rope which is threaded through the central holes in the ends of the sleeves and through the longitudinal holes defined by the pipes disposed within each of the flotation members. Opposite ends 62 and 64 of the rope extend forwardly of the forward end of the arm rest portions 12 and 14 as seen in FIG. 1. Adjuster means for adjusting the position of the connector includes a pair of similar manually operable adjuster devices 70 and 72 which are attached to ends 62 and 64 respectively of the rope. While a pair of adjuster devices is considered desirable, a single adjuster device may be employed at one end of the rope, with the opposite end of the rope anchored in place.

Figure 4:
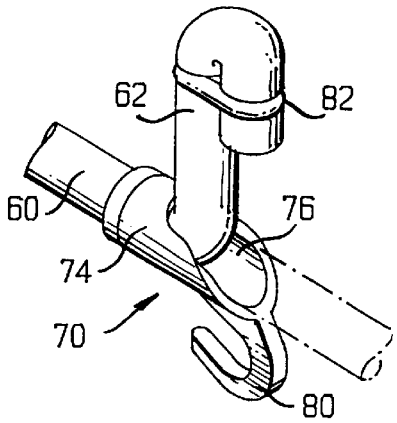
FIG. 4 is a perspective view showing the adjuster device.

Referring to FIG. 4, the adjuster device 70 attached to the end 62 of rope 60 is shown in detail. This adjuster device is commercially available and is formed of a rigid material such as metal or plastic. A hollow cylindrical portion 74 receives the rope through the open end thereof. A V-shaped notch 76 is formed in the wall of cylindrical portion 74 and is adapted to receive end 62 of the rope. It is apparent that the end of the rope can be moved away from the smaller end of the notch, whereupon the length of the rope between the two adjuster devices can be adjusted to a desired length. The end of the rope can then be moved back into the smaller end of the slot as shown. When tension is applied to the rope, the end of the rope is drawn tightly into the narrow portion of the slot to lock the rope in position. A handle portion 80 is formed integral with cylindrical portion 74 so that a user can hold onto the device when adjusting the position of the rope. It is noted that end 62 of the rope is doubled upon itself and held in position by a suitable clamp 82 so that when the rope subjected to tension, it will not be accidently pulled through the adjuster device.

Figure 5:
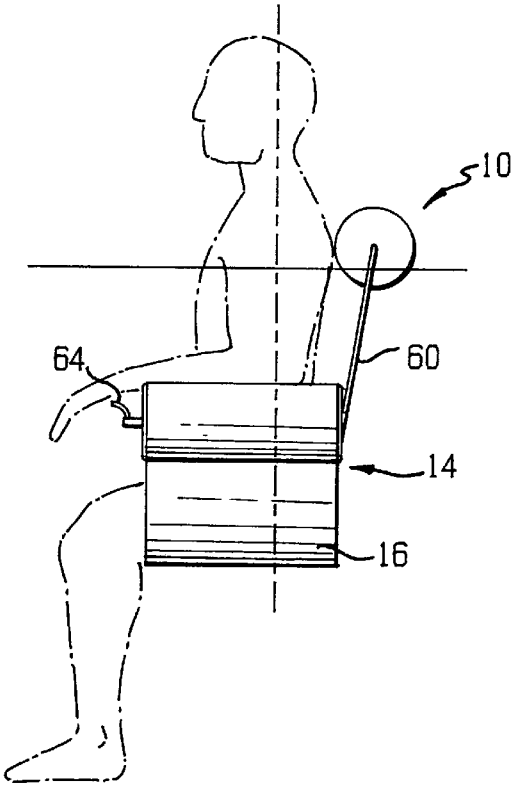
FIG. 5 is a side view showing the position of the chair when holding a large heavy person.

As seen in FIG. 5, a large heavy person is shown as being supported within the chair. In this position, the rope is extended to its maximum length so that the back rest portion is spaced a maximum distance from the arm rest portions. This provides a comfortable upright sitting position for the user with the arm rest portion and back rest portion of the chair properly engaging the user's body.

Figure 6:
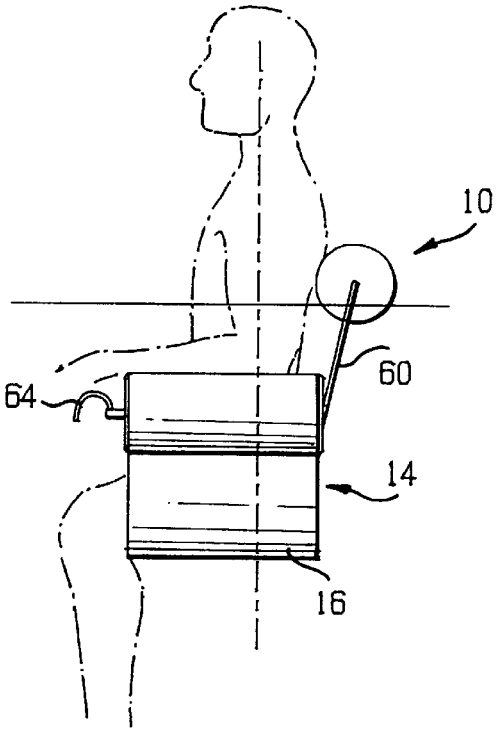
FIG. 6 is a side view showing the position of the chair when holding a medium size person.

As seen in FIG. 6, a medium size user is shown as being supported within the chair. It is noted that the length of the rope has been reduced by pulling forward on opposite ends of the rope and then locking the rope ends in place with use of the adjuster devices. Here again, the back rest portion of the chair contacts the proper part of the user's back.

Figure 7:
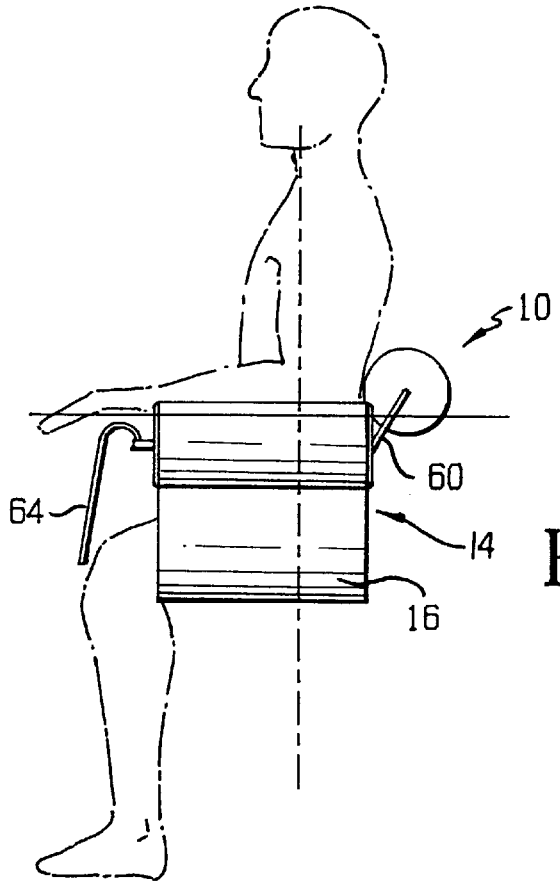
FIG. 7 is a side view showing the position of the chair when holding a small light person.

FIG. 7 shows a small light person supported within the chair. The length of the rope has been reduced to a minimum and locked in position with the back rest portion of the chair adjacent the arm rest portions thereof.

Figure 8:
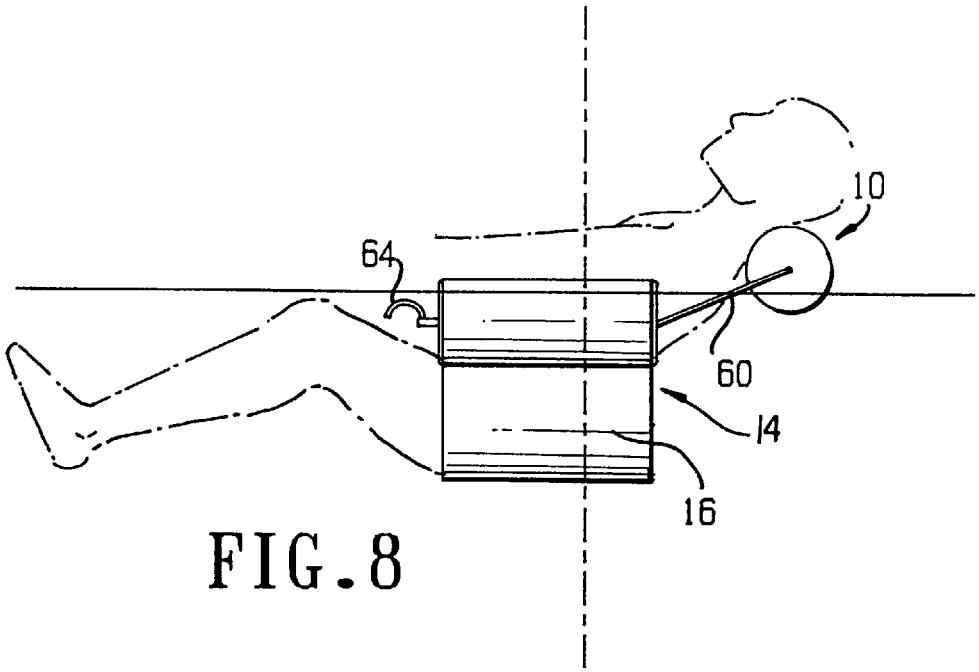
FIG. 8 is a side view showing the position of the chair when holding a medium size person in a reclining position.

FIG. 8 shows the chair with a medium size person supported in a reclining position. In order to assume this position, the rope is extended to its maximum length similar to that shown in FIG. 5. However, whereas this adjusted position of the rope is suitable for supporting a large heavy person in an upright position, it is also capable of supporting a medium size person in a reclining position.

It is apparent that the adjustable feature of the invention permits the spacing of the back rest portion from the arm rest portions to be varied to accommodate persons of different size and to enable user's to assume different positions in the water.

The invention has been described with reference to a preferred embodiment. Obviously, various modifications, alternatives and other embodiments will occur to others upon reading and understanding this specification. It is my intention to include all such modifications, alternatives and other embodiments insofar as they come within the scope of the appended claims or equivalents thereof.

What is claimed is:

1. A flotation device comprising, a back rest portion, a pair of arm rest portions, and a seat portion, said seat portion being formed of flexible material and being suspended between said arm rest portions, each of said back rest and arm rest portions including a separate buoyant flotation member having a hole formed therethrough to facilitate adjustment of said back rest portion and said arm rest portions, said back rest portion being movable independently of said arm rest portions, a flexible connector interconnecting said back rest portions and said arm rest portions, and adjuster means for adjusting the position of the connector to vary the distance of said back rest portion relative to said arm rest portions.

2. A flotation device comprising, a back rest portion, a pair of arm rest portions, and a seat portion, said seat portion being formed of flexible material and being suspended between said arm rest portions, each of said back rest and arm rest portions including a separate elongated buoyant flotation member having a hole formed longitudinally therethrough, said back rest portion being movable independently of said arm rest portions, a flexible connector extending through said holes of said back rest portions and said arm rest portions, and adjuster means for adjusting the position of the connector to vary the distance of said back rest portion relative to said arm rest portions.

3. A flotation device as defined in claim 2 wherein said connector has opposite ends, said adjuster means including a manually operable adjuster device attached to one of said ends.

4. A flotation device as defined in claim 3 wherein said adjuster means also includes a manually operable adjuster device attached to the other of said ends.

5. A flotation device as defined in claim 2 wherein the hole formed longitudinally through each of said flotation members is defined by a tubular rigid member extending through the associated flotation member.

6. A flotation device as defined in claim 2 wherein said seat portion includes a pair of sleeves at opposite sides thereof, each sleeve receiving an associated flotation member.

7. A flotation device as defined in claim 6 wherein each of said sleeves has opposite end portions which at least partially enclose end portions of the associated flotation member to prevent the flotation member from escaping from the associated sleeve.

8. A flotation device as defined in claim 2 wherein said back portion includes a sleeve which receives an associated flotation member, said sleeve having opposite end portions which at least partially enclose end portions of the associated flotation member to prevent the flotation member from escaping from the associated sleeve.

* * * * *